US005339137A

United States Patent [19]

Kusumoto et al.

[11] Patent Number: 5,339,137

[45] Date of Patent: Aug. 16, 1994

[54] IMAGE FORMING APPARATUS

[75] Inventors: Hiroshi Kusumoto; Daisuke Hayashi; Hideki Ishida; Shoichi Kitagawa; Takashi Nagashima; Mitsugu Miyamoto, all of Osaka, Japan

[73] Assignee: Mita Industrial Co., Ltd., Osaka, Japan

[21] Appl. No.: 120,717

[22] Filed: Sep. 13, 1993

[30] Foreign Application Priority Data

Sep. 17, 1992 [JP] Japan ..... 4-248172
Sep. 24, 1992 [JP] Japan ..... 4-254828

[51] Int. Cl.[5] ..... G03G 15/02
[52] U.S. Cl. ..... 355/208; 355/221
[58] Field of Search ..... 355/207, 208, 221; 250/324-326

[56] References Cited

U.S. PATENT DOCUMENTS 4,203,144 5/1980 Okamoto ..... 361/234
4,252,431 2/1981 Cormier .
4,320,957 3/1982 Brown et al. .
5,142,329 8/1992 Nakaya ..... 355/221

FOREIGN PATENT DOCUMENTS 0493088 7/1992 European Pat. Off. .

OTHER PUBLICATIONS

Patent Abstracts of Japan, vol. 10, No. 354 (P-521) Nov. 28, 1986 & JP-A-61 151 669 (Mita Ind.) Jul. 10, 1986.
Patent Abstracts of Japan, vol. 15, No. 140 (P-1188) Apr. 9, 1991 & JP-A-03 017 667 (NEC Corp.) Jan. 25, 1991.
Patent Abstracts of Japan, vol. 7, No. 245 (P-233)(1390) Oct. 29, 1983 & JP-A-58 132 259 (Ricoh) Aug. 6, 1983.
Patent Abstracts of Japan, vol. 8, No. 282 (P-323)(1719) Dec. 22, 1984 & JP-A-59 148 071 (Matsushita Denki Sangyo) Aug. 24, 1984.
Patent Abstracts of Japan, vol. 10, No. 127 (P-455)(2184) May 13, 1986 & JP-A-60 252 376 (Ricoh) Dec. 13, 1985.
Patent Abstracts of Japan, vol. 5, No. 81 (P-63) (753) May 27, 1981 & JP-A-56 27 165 (Tokyo Shibaura Denki) Mar. 16, 1981.

*Primary Examiner*—R. L. Moses
*Attorney, Agent, or Firm*—Jordan and Hamburg

[57] ABSTRACT

An image forming apparatus includes a photosensitive body, a charge wire disposed along the photosensitive body at a specified spacing from the photosensitive body and adapted for charging the photosensitive body, the charge wire being tiltable on a plane passing an entirety of the charge wire and perpendicularly intersecting a surface of the photosensitive body. This apparatus is provided with a detector for detecting an image density distribution in a main scanning direction of copy paper, tilt angle calculator for calculating, based on a detected image density distribution, a correcting tilt angle of the charge wire to obtain a desired image density distribution in the main scanning direction, and a tilt angle controller for controlling the tilt angle in accordance with a calculated correcting tilt angle.

9 Claims, 6 Drawing Sheets

IMAGE FORMING APPARATUS

BACKGROUND OF THE INVENTION

The present invention relates to an image forming apparatus such as a copying machine which forms a toner image by attracting toner powder onto photosensitive means and then transfers the toner image onto a sheet of copy paper. More particularly, the invention relates to an image forming apparatus capable of properly adjusting image density distribution in a main scanning direction of the copy paper.

Generally in image forming apparatuses such as copying machines, a photosensitive drum is charged to a certain potential by charging means and exposed to light to produce an electrostatic latent image of an original document. Distribution of charge potential on the surface of the photosensitive drum is usually flattened in its axial direction in order to create uniform image density on the copy paper in its main scanning direction (or widthwise).

Even when the charge potential distribution in the axial direction of the photosensitive drum is flat, however, the latent image density distribution in the same direction may become uneven due to variations in exposure to light from a lamp, a disparity in the charging efficiency of the photosensitive drum, or smears on a charge wire or a shield case that constitute the charging means. In such a case, density of the toner image produced on the surface of the photosensitive drum becomes uneven in the main scanning direction, causing partial fog on the front or rear side, for example, when the toner image is transferred onto the copy paper.

Various arrangements have been proposed hitherto to solve this problem.

One example of such arrangements is disclosed in Japanese Unexamined Patent Publication No. 61-151669. According to the disclosure, there is made provision for measuring surface potential of the photosensitive drum, for example. Then, based on measurement results, the surface potential distribution is evened out by adjusting the tilt angle formed by the charge wire and the surface of the photosensitive drum in its axial direction.

Another example is disclosed in Japanese Unexamined Patent Publication No. 3-17667. According to this disclosure, there are provided on the downstream side of the photosensitive drum a plurality of density sensor elements arranged at regular intervals in the main scanning direction. As the copy paper is separated from the photosensitive drum and conveyed downstream, the density sensor elements detect image density on the copy paper. Then, exposure of the photosensitive drum is controlled based on the resultant image density data.

In the first example of known arrangements described above, the tilt angle of the charge wire is adjusted based on measurements of surface potential of the photosensitive drum. With this process, however, it is essentially difficult to completely eliminate the cause of fog. This is because unevenness on the copy paper in its main scanning direction cannot be fully suppressed in case the image density unevenness results from irregularities in optical system's luminous intensity, sensitivity of the photosensitive drum or moisture absorption status of the copy paper.

In the second example of known arrangements described above, it is difficult to obtain reliable image density data. This is because the distance between the density sensor elements and copy paper can hardly be kept constant since image density is measured while the copy paper is being conveyed. Another problem of this arrangement is that because the density sensor elements are placed at intervals in the main scanning direction of the copy paper, there exist gaps or dead zones between individual sensor elements, making it difficult to obtain an accurate measurement of the image density distribution. Moreover, the use of a plurality of density sensor elements is likely to result in a higher product cost.

SUMMARY OF THE INVENTION

The present invention has been made to provide an image forming apparatus which can solve the above problems. Accordingly, it is an object of the invention to provide an image forming apparatus which can reduce unevenness in image density in a main scanning direction of copy paper and thereby prevent fog by adjusting surface potential distribution on a photosensitive drum in its axial direction based on a measurement of image density distribution on the copy paper.

An image forming apparatus of the present invention comprises: a photosensitive body; a charge wire disposed along the photosensitive body at a specified spacing from the photosensitive body and adapted for charging the photosensitive body, the charge wire being tiltable on a plane passing an entirety of the charge wire and perpendicularly intersecting a surface of the photosensitive body; detecting means for detecting an image density distribution in a main scanning direction of copy paper carrying a copied image of an original document; tilt angle calculating means for calculating, based on a detected image density distribution, a correcting tilt angle of the charge wire to obtain a desired image density distribution in the main scanning direction; and tilt angle control means for controlling the tilt angle of the charge wire in accordance with a calculated correcting tilt angle.

With this configuration, the tilt angle of the charge wire is adjusted based on the image density distribution in the main scanning direction of the copy paper in such a manner that the charge potential on the photosensitive body is reduced where the image density is higher and increased where the image density is lower. Accordingly, irregularities in image density distribution can easily be corrected, which thus preventing fog due to unevenness in exposure levels or amount of toner power in the development process.

The image forming apparatus may be further provided with voltage calculating means for calculating, based on a detected image density distribution, a correcting application voltage for the charge wire to obtain a specified image density, and voltage control means for controlling the application voltage for the charge wire in accordance with a calculated correcting application voltage.

Provided with such additional means, the image forming apparatus can adjust the voltage to be applied to the charge wire based on the image density distribution in the main scanning direction of the copy paper. Thus, it is possible to adjust not only the charge potential distribution in the axial direction of the photosensitive means but also its overall charge potential level so that the image density can be finely corrected.

Further, it may be appropriate to further provide memory means for storing information about optimum image density distribution for a reference original member, and render the tilt angle calculating means calculate a correcting tilt angle of the charge wire comparing a detected image density distribution with the optimum image density distribution.

Provided with the memory means as described above, the image forming apparatus compares the density of the copied image of the reference original member with the optimum image density stored in the memory means, enabling accurate image density correction.

Further, it may be appropriate to further provide document holder means having a document holding portion for holding an original document and a reference original member outside the document holding portion, and scanning means for scanning the original document and reference original member, the scanning means being capable of selectively scanning either of the reference original member and the original document.

With this configuration, image density adjustment can be more easily performed because the requirement is eliminated of placing a reference original document separately.

The detecting means may be constructed by a sensor having a plurality of photoelectric devices arranged in a main scanning direction of copy paper. Accordingly, an image density of the plurality of points are detected, enabling quick evaluation of an image density distribution.

Also, the detecting means may be constructed by a reflection type sensor capable of detecting an image density based on an amount of reflected light from copy paper, and a driving portion for moving the reflection type sensor in a main scanning direction of copy paper, and a controlling portion for controlling the driving portion.

This configuration will offer a reduced number of sensors, structural simplification and eventual cost savings.

Further, it may be appropriate to mount the charge wire on a shield case having an opening facing an surface of the photosensitive body having opposite end portions, one end portion being movable so as to change the tilt angle of the charge wire.

This configuration will provide a simplified construction for density adjustment because the tilt angle of the charge wire is adjusted by moving at least one end portion.

Further, the image forming apparatus may be provided with paper refeeding means for refeeding copy paper having a copied image on one side thereof to the photosensitive body to form another image on the other side of the copy paper, the paper refeeding means having intermediate paper storage means for temporarily storing the copy paper having a copied image on one side thereof, wherein the detecting means is provided above the intermediate paper storage means to detect an image density of a copied image on the one side of the copy paper stored on the intermediate paper storage means.

With thus constructed image forming apparatus, detection of image density distribution is carried out for copy paper placed on the intermediate paper storage means. Accordingly, the detection accuracy can be improved.

Also, it may be appropriate to further provide judgement means for judging whether the tilt angle of the charge wire is adjusted, refeeding controlling means responsive to the judgement means for controlling the refeeding means to refeed the copy paper carrying a copied image on one side thereof to the photosensitive body to form the image of the reference original member on the other side of the copy paper if the tilt angle of the charge wire is adjusted, and controlling the refeeding means to convey the copy paper carrying a copied image of the reference original member on the other side to the intermediate paper storage means to detect an image density distribution of the copied reference original image.

With thus constructed image forming apparatus, if the tilt angle is adjusted, the reference original member image is copied on the other side, and an image density distribution of the copied image is detected. Accordingly, an improved density adjustment can be attained.

These and other objects, features and advantages of the present invention will become more apparent after having read the following detailed disclosure of preferred embodiments, which are illustrated in drawings.

DETAILED DESCRIPTION OF THE PREFERRED EMBODIMENTS OF THE INVENTION

The invention will be described as being embodied in a copying machine, referring to the accompanying drawings.

Figure 1:
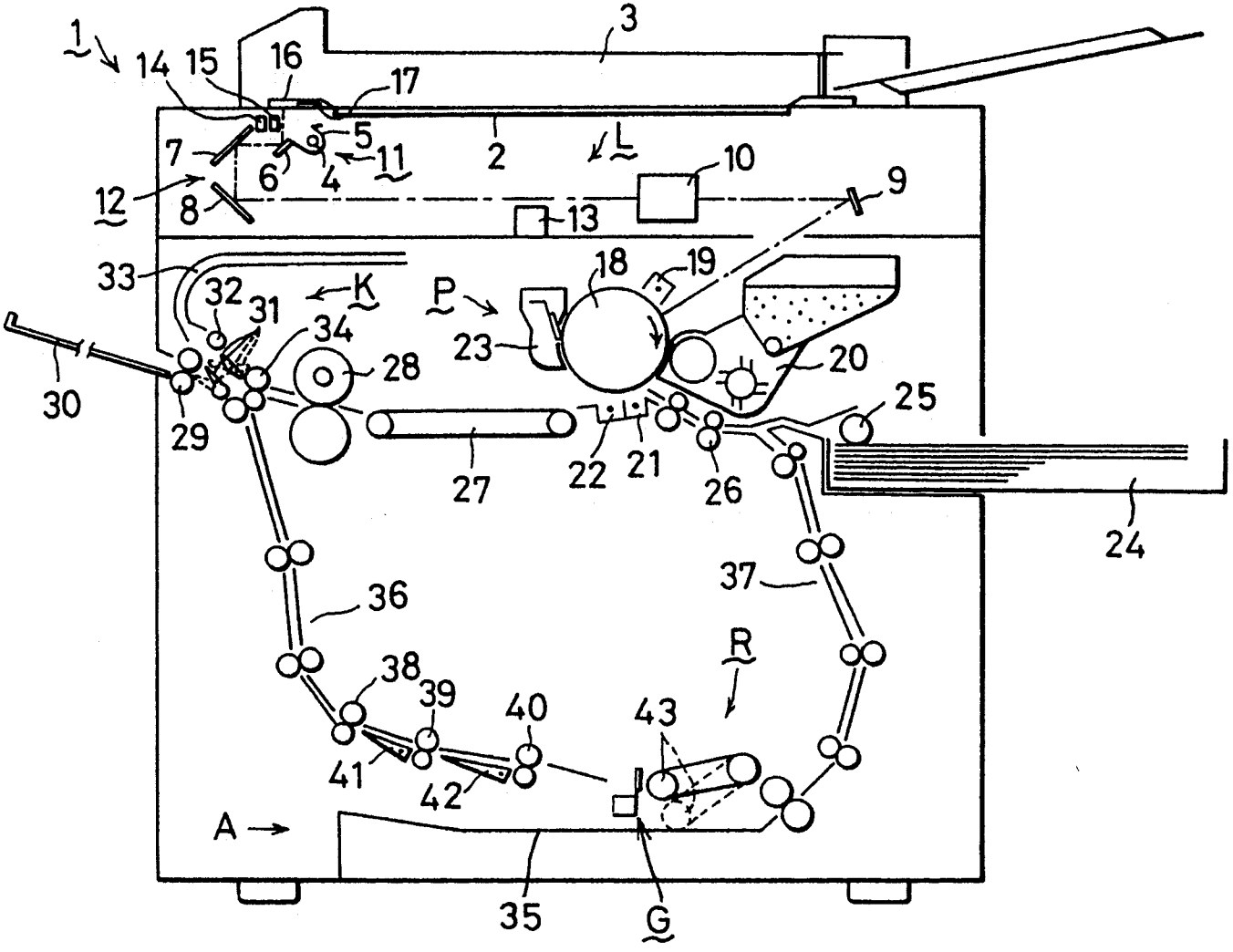
FIG. 1 is a diagram schematically showing a copying machine according to the present invention.

FIG. 1 is a diagram schematically showing a copying machine according to the present invention. As seen in FIG. 1, a copying machine 1 comprises in its basic configuration an original glass plate 2 at the top and an automatic document feeder 3 for automatic feed and discharge of original documents on top of the original glass plate 2, as well as an optical portion L, an image forming portion P, a paper inverting mechanism K, a paper refeeding mechanism R, and a paper conveying mechanism for conveying copy paper inside the machine body.

The optical portion L includes a first optical system 11 comprising a tungsten halogen lamp 4 and reflecting mirrors 5 and 6, a second optical system 12 comprising reflecting mirrors 7 and 8, as well as a reflecting mirror 9 and a focusing lens 10. At approximately the middle of the optical portion L, there is provided an optical system drive motor 13. When driven by the optical system drive motor 13, the first and second optical systems 11–12 move reciprocally at specified intervals projecting an image of each original document on the image forming portion P. In particular, the first optical system 11 is made reciprocally movable under the original glass plate 2 beyond the right and left limits of the secondary scanning range up to where a home position switch 14 is located. The first optical system 11 employs this "overrun" feature to help stabilize its startup travel speed and luminous intensity of the tungsten halogen lamp 4.

The home position switch 14 is located at an initial setup position of the first and second optical systems 11–12. Also, there is provided a timing switch 15 in the proximity of the home position switch 14. By detecting the first and second optical systems 11–12 set at the initial setup position, these switches indicate the operating timing for individual mechanisms of the copying machine 1. Between the position where the timing switch 15 detects the first optical system 11 and the end of the original glass plate 2, on the underside of a marker plate 16 for indicating a line with which the leading edge of an original should be aligned, there is provided a reference original member 17 for adjusting exposure, surface potential of a photosensitive drum, developing bias and other image forming conditions. The reference original member 17 is mounted flush with the original glass plate 2 to ensure optimum detecting accuracy. The reference original member 17 has a reference white surface making it possible to detect the fog effect.

The image forming portion P comprises a photosensitive drum 18 for carrying an electrostatic latent image according to an original image projected from the optical portion L, a charging unit 19 for charging the surface of the rotating photosensitive drum 18 to a specified potential, a developing unit 20 for producing a toner image from the electrostatic latent image, a transfer unit 21 for transferring the toner image from the photosensitive drum 18 onto a sheet of copy paper, a separator 22 for separating the copy paper from the photosensitive drum 18 after the image transfer process, and a cleaning unit 23 for removing toner particles remaining on the photosensitive drum 18.

As will be discussed later, the copying machine 1 therein described is so designed that the charge wire positioned parallel to the surface of the photosensitive drum 18 can be inclined in its axial direction depending on the image density distribution detected by a density detecting unit G. More specifically, it is made possible to tilt a charge wire of the charging unit 19 to a desired angle within a plane containing the axis of the photosensitive drum 18.

Figure 2:
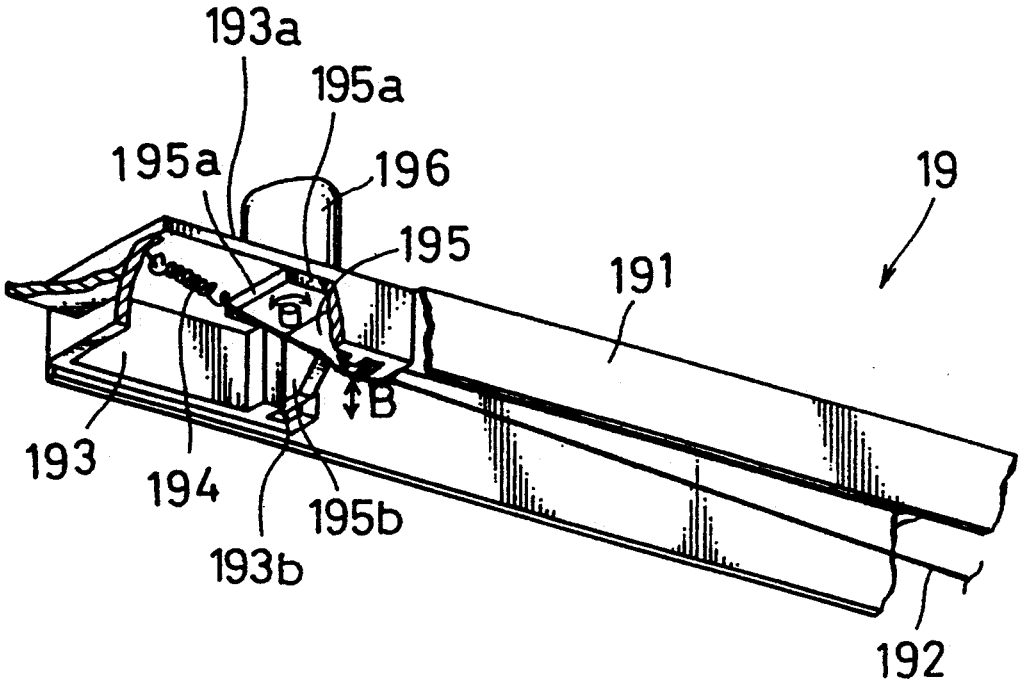
FIG. 2 is a fragmentary perspective view partially in section showing a construction of a charging unit as a first embodiment of the invention.

FIG. 2 is a fragmentary perspective view partially in section showing a construction of the charging unit 19 as a first embodiment of the invention.

Referring to FIG. 2, indicated at 191 is a shield case made of a metal or other electrically conductive material having a channel-like cross section; indicated at 192 is a charge wire; indicated at 193 is an end block for fixing the front end of the charge wire 192; indicated at 194 is an extension spring for stretching the charge wire 192; and indicated at 195 is a bridge for supporting the charge wire 192 near its front end.

Having an L-shaped cross section, the bridge 195 is a resin element including a base portion **195*a* and a support portion 195*b*. There is provided a tapped hole at an approximate center of the base portion 195*a* and a V-groove is formed at an end of the support portion 195*b* for retaining the charge wire 192. Both sides of the support portion 195*b* are fitted into guide grooves 193*b* formed inside the end block 193 while a motor 196 is mounted on the end block 193 with its rotary shaft screwed into the tapped hole in the base portion 195*a*. With this arrangement, the bridge 195 can be moved up and down in relation to a top plate 193*a* of the end block 193, as shown by arrows B in FIG. 2, by turning the motor 196** in its normal and reverse directions.

Although not illustrated, there is another end block at the rear end of the charge wire 192, where the charge wire 192 is supported by a bridge at a certain distance from the end block's top plate. In the embodiment of FIG. 2, the rear bridge is fixed to the top plate without any means for height adjustment so that the rear end of the charge wire 192 is kept at a given distance from the surface of the photosensitive drum 18. In a modified form of embodiment, the rear bridge may be constructed in a similar manner to the front bridge 195. In this case, the rear bridge can also be moved up and down in relation to the top plate.

The shield case 191 is mounted in parallel with the axis of the photosensitive drum 18 with its open side facing the photosensitive drum 18 with a certain clearance. The distance from the front end of the charge wire 192 to the surface of the photosensitive drum 18 is adjustable by vertically moving the bridge 195 so that the tilt angle of the charge wire 192 can be varied within a plane containing the axis of the photosensitive drum 18.

It is well known that the electrostatic charge potential on the photosensitive drum 18 rises as the charge wire 192 is brought closer to the photosensitive drum 18. This means that if the charge potential on the drum surface varies in the axial direction of the photosensitive drum 18 when the tilt angle of the charge wire 192 is 0 degrees (or when the charge wire 192 is parallel with the axis of the photosensitive drum 18), the inclination of the charge potential can be eliminated by adjusting the tilt angle of the charge wire 192. This manner of adjustment makes it possible to correct density unevenness in the main scanning direction of a copied image, thereby reducing fog on copy paper. Correction of copy density unevenness will be discussed later in detail.

Figure 3:
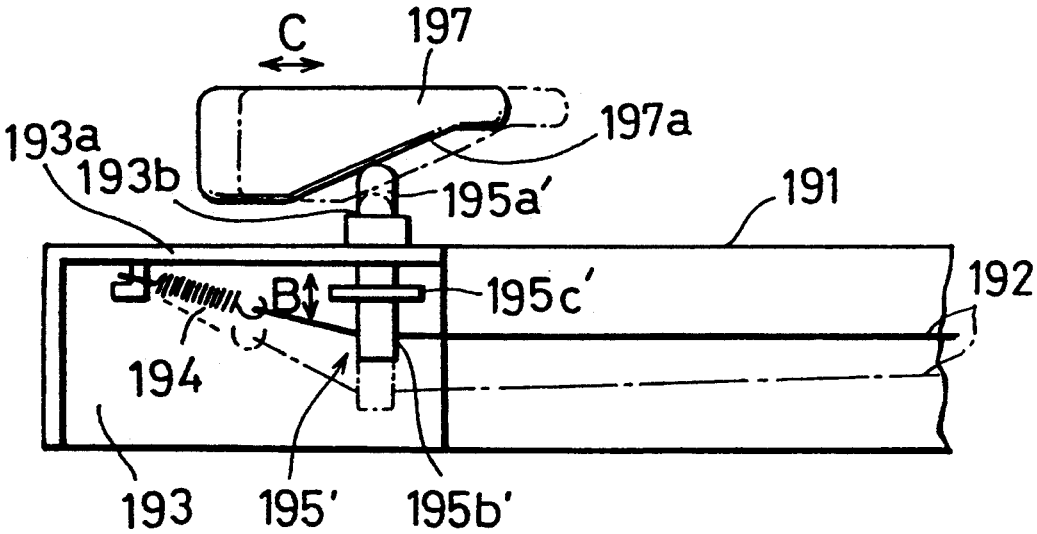
FIG. 3 is a fragmentary sectional view showing a construction of a charging unit as a second embodiment of the invention.

FIG. 3 is a fragmentary sectional view showing another charging unit 19 as a second embodiment of the invention.

In FIG. 3, a bridge 195' comprises a rod base portion **195*a*' and a support portion 195*b*' with a projecting flange 195*c*' mounted between both. Further, there is provided a guide hole 193*b*' at an appropriate position on a top plate 193*a*' of an end block 193'. Above the guide hole 193*b*', there is mounted a sliding contact member 197 having a tapered contact surface 197*a* on the bottom side so that the sliding contact member 197 can be moved in the back-and-forth direction, as shown by arrows C in FIG. 3**, driven by a motor (not illustrated).

The bridge 195' is mounted with its base portion **195*a*' passing through the guide hole 193*b*' on the top plate 193*a*' of the end block 193' so that the bridge 195' can be moved in the vertical direction. The bridge 195' is pushed upward by the stretched charge wire 192 while its upward movement is restricted since the upper end of the base portion 195a' presses against the contact surface 197a of the sliding contact member 197. When the sliding contact member 197 is moved in the back-and-forth direction, the upper end of the base portion 195a' slides along the contact surface 197a causing the bridge 195' to move in the vertical direction. In case the sliding contact member 197 is moved to such an extent that the base portion 195a' goes out of contact with the contact surface 197a, the flange 195c' is stopped by the top plate 193a' of the end block 193' in order that the bridge 195' will not come off from the end block 193'**.

Referring again to FIG. 1, the paper conveying mechanism comprises, from the upstream side, a paper cassette 24, a paper feed roller 25 and a pair of register rollers 26. Each sheet of copy paper is sent to the photosensitive drum 18 and a toner image is transferred onto the copy paper. The paper conveying mechanism on the downstream side of the photosensitive drum 18 comprises a conveying belt 27, a fixing unit 28, a pair of output rollers 29 and a copy output tray 30 for discharging the copy paper after the image transfer process.

The paper inverting mechanism K is located between the fixing unit 28 and the pair of output rollers 29. It includes a path selector plate 31, a reversing roller 32 and an inverting path 33. The path selector plate 31 can be set to different positions shown by solid lines and dashed lines in FIG. 1 to switch between alternative paper paths: one for guiding the copy paper straight from a pair of conveying rollers 34 to the pair of output rollers 29, and the other for guiding the copy paper after the fixing process into the inverting path 33 and then sending out the inverted copy paper into the paper refeeding mechanism R. When the copy paper is being sent to the paper refeeding mechanism R, the reversing roller 32 is offset and brought into contact with the upper output roller 29.

The paper refeeding mechanism R forms a returning paper path from the paper inverting mechanism K to the paper feeding side. It comprises an intermediate tray 35, an interconnecting path 36 for guiding the copy paper to the intermediate tray 35, and a refeeding path 37 for feeding the copy paper from the intermediate tray 35 back to the image forming portion P. Provided immediately on the upstream side of the intermediate tray 35 are three pairs of conveying rollers 38, 39 and 40 forming part of the interconnecting path 36 and short-cut path selector 41 and 42 between them for adjusting the length of paper path up to the intermediate tray 35 depending on the paper size. Further, there are provided near the forward edge of the intermediate tray 35 a refeeding roller 43 for feeding back the copy paper and a density detecting unit G which will be discussed later.

In the copying machine 1 described above. light emitted by the tungsten halogen lamp 4 is reflected by the original document and the reflected image is directed to the photosensitive drum 18 via the reflecting mirrors 6, 7 and 8, focusing lens 10 and reflecting mirror 9. While the photosensitive drum 18 rotates in the direction of arrow shown in FIG. 1, the charging unit 19 charges the drum surface to a specified potential. Then, an electrostatic latent image is produced on the photosensitive drum 18 as it is exposed to the image projected from the optical portion L. After the electrostatic latent image on the surface of the photosensitive drum 18 has been developed by the developing unit 20, the transfer unit 21 transfers the resultant toner image onto a sheet of copy paper fed from the paper cassette 24. Following the image transfer process, the copy paper is separated from the photosensitive drum 18 by the separator 22 and discharged onto the copy output tray 30 via the conveying belt 27, fixing unit 28 and output rollers 29.

On the other hand, when copying on both sides of a sheet of paper, the path selector plate 31 is set as shown by solid lines in FIG. 1 in order that the already fixed copy paper is once led into the inverting path 33. Then, guided through the interconnecting path 36, the copy paper is carried down and placed on the intermediate tray 35 with the already copied side facing upward. Outputted from the intermediate tray 35 at proper timing by means of the refeeding roller 43, the copy paper is sent back to the image forming portion P through the refeeding path 37. Subsequently, the aforementioned processes are repeated to copy an image of another original document on the reverse side of the copy paper and discharge it onto the copy output tray 30.

Figure 4:
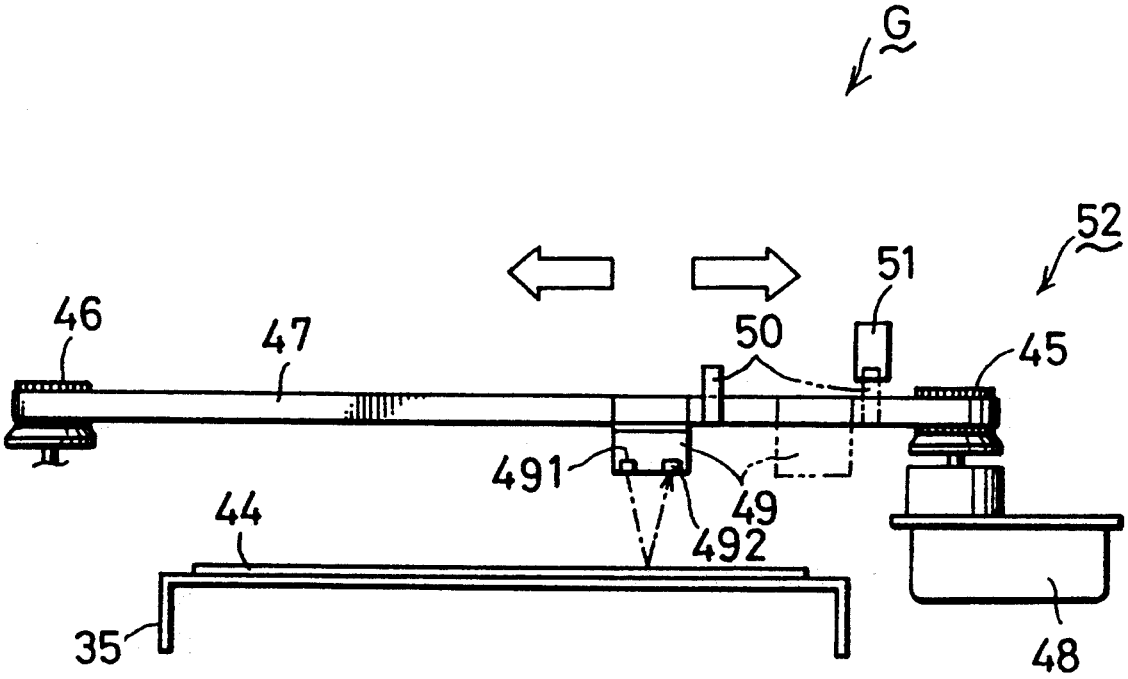
FIG. 4 is a view taken in the direction of arrow A of FIG. 1 showing a density detecting unit of the copying machine of the present invention.

The density detecting unit is now described referring to the attached drawings. FIG. 4 is a view taken in the direction of arrow A of FIG. 1 showing an example of a density detecting unit that can be employed in the copying machine of the present invention.

The density detecting unit G comprises a density sensor 49 for detecting the density of an image on a sheet of copy paper 44 stored on the intermediate tray 35 and a drive assembly 52 for moving the density sensor 49 in the main scanning direction (back-and-forth direction of the copying machine 1, or the direction of arrows illustrated in FIG. 4) of the copy paper 44.

The drive assembly 52 comprises a front pulley 45, a rear pulley 46, an endless timing belt 47 mounted between the front and rear pulleys 45–46, and a stepping motor 48 for turning the front pulley 45. Since the stepping motor 48 can be driven in either the normal or reverse direction, the timing belt 47 can rotate in either direction. Attached to an appropriate position of the timing belt 47, the density sensor 49 moves in the back-and-forth direction according to normal or reverse rotation of the timing belt 47.

The density sensor 49 is, for example, a reflection-type photosensor including a light emitting device 491 and a photosensitive device 492. In order to detect the density of an image on the copy paper 44 stored on the intermediate tray 35, the density sensor 49 is mounted with its light emitting device 491 and photosensitive device 492 facing down. Light emitted downward from the light emitting device 491 is reflected by the copy paper 44 and received by the photosensitive device 492. The intensity of received light is proportional to the image density, that is to say, lighter areas of the image produce higher light intensity while denser areas produce lower light intensity. Consequently, it is possible to find image density distribution in the main scanning direction of the copy paper 44 by measuring the received light intensity corresponding to the position of the density sensor 49 in the main scanning direction.

Further, a positioning tab 50 is attached to the timing belt 47 while a position sensor 51 is provided close the front pulley 45. This arrangement establishes a home position of the density sensor 49, or a geometrical reference position for image density distribution.

To prevent the density sensor 49 from interfering with sheets of copy paper stacked on the intermediate tray 35 in normal mode, the front and rear pulleys 45–46 are located at an appropriate height from the top surface of the intermediate tray 35.

In the density detecting unit G of the above configuration, as the stepping motor 48 is driven by a control unit (not illustrated), the timing belt 47 is turned via the front pulley 45. As a result, the density sensor 49 moves forward while reading the density of an image in the main scanning direction of the copy paper 44 placed on the intermediate tray 35. The result of detection is stored in a memory 531 (shown in FIG. 5) together with positional information. Upon completing an image density read sequence, the density sensor 49 is returned to its home position.

Figure 5:
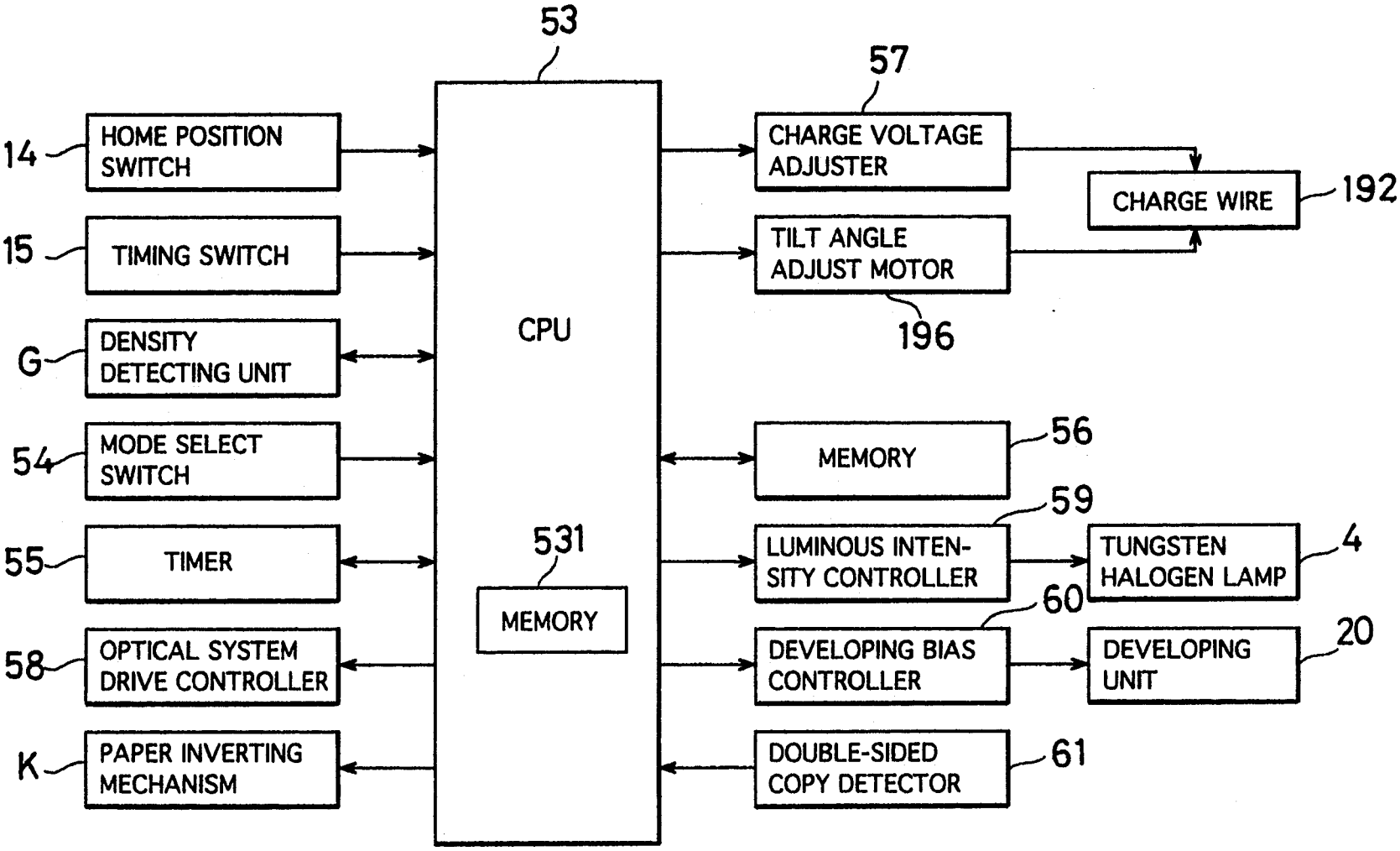
FIG. 5 is a block diagram of a control system of the copying machine.

FIG. 5 is a block diagram of a control system adopted in the copying machine 1. In FIG. 5, internal units and components identical to those shown in FIGS. 1 and 2 are identified by using the same reference numbers. Indicated by reference number 53 is a central processing unit (hereinafter referred to as CPU) for controlling overall operation of the copying machine 1. The CPU 53 controls normal image forming operation as well as copy density adjustment operation for obtaining a copy having a proper and uniform image density distribution in the main scanning direction of the copy paper 44. These operation modes are hereinafter referred to as normal copy mode and image density adjustment mode, respectively. The CPU 53 has an internal memory 531 for storing image density information obtained by the density detecting unit G. In image density adjustment mode, the CPU 53 calculates a tilt angle to which the charge wire 192 should be adjusted based on the detected image density distribution and drives the tilt angle adjust motor 196 in accordance with the result of calculation to set the charge wire 192 of the charging unit 19 to the required tilt angle.

Indicated by reference number 54 is a mode select switch for switching between the normal copy mode and image density adjustment mode. The mode select switch 54 may be provided on the top of the copying machine 1, for example. Indicated by reference number 55 is a timer for controlling movement of the first optical system 11 to a desired position in order to read an image of the reference original member 17 in image density adjustment mode. Indicated by reference number 56 is a memory for storing information about optimum density of copy paper on which an image of the reference original member 17 has been copied. Indicated by reference number 57 is a charge voltage adjuster for adjusting the voltage to be applied to the charge wire 192 of the charging unit 19. As an example, the charge voltage adjuster 57 adjusts an output of a charge voltage generating transformer based on a control signal from the CPU 53.

Indicated by reference number 58 is an optical system drive controller for controlling the driving of the first and second optical systems 11–12; indicated by reference number 59 is a luminous intensity controller for controlling the luminous intensity of the tungsten halogen lamp 4; indicated by reference number 60 is a developing bias controller for controlling the developing bias to be applied to a developing roller in the developing unit 20; and indicated by reference number 61 is a double-sided copy detector for checking completion of copying on both sides of copy paper. The optical system drive controller 58, luminous intensity controller 59 and developing bias controller 60 also control the driving of respective actuators based on a control signal from the CPU 53.

The double-sided copy detector 61 comprises, for example, a sensing device for detecting a sheet of copy paper carried onto the intermediate tray 35. When a sheet of copy paper is detected by this sensing device, it is judged that an image will be copied on the reverse side of the sheet in the next image forming process. It is therefore possible to judge from the output status of the sensing device whether double-sided copying has been completed. Alternatively, completion of double-sided copying may be judged by counting the number of copy operations. More specifically, it would be possible, for example, to judge that double-sided copying has been completed every second count of successive copy operations in double-sided copy mode.

Figure 6A:
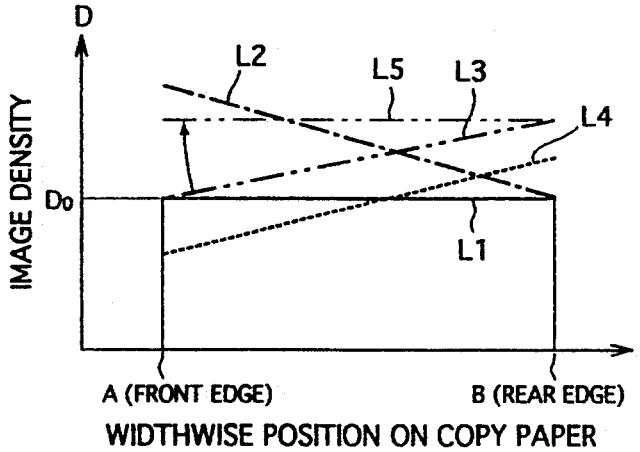
FIGS. 6A and 6B are a graph and a representation of the copy paper, respectively, illustrating image density distributions in a main scanning direction of copy paper carrying a copied image of a reference original.

Image density adjustment mode is now briefly described referring to FIGS. 6A to 8. FIGS. 6A is a graph illustrating image density distributions in the main scanning direction of the copy paper carrying a copied image of the reference original member 17. FIG. 6A shows several forms of image density distributions assuming that the photosensitive drum 18 has been charged by the charge wire 192 of the charging unit 19 stretched in parallel with the axis of the photosensitive drum 18 (tilt angle 0 degree). The vertical axis represents image density D while the horizontal axis represents the main scanning direction of the copy paper. Further, point A on the horizontal axis corresponds to a point on the front side edge of the copy paper while point B corresponds to a point on the rear side edge of the copy paper.

In FIG. 6A, line L1 shows a status where image density D is uniform and proper across the copy paper in the main scanning direction. Line L2 shows a state where image density D is proper at the rear side edge of the copy paper and increases toward the front side edge of the copy paper. Contrarily, line L3 shows a state where image density D is proper at the front side edge of the copy paper and increases toward the rear side edge of the copy paper. Line L4 shows a state where image density D increases from the front side edge of the copy paper toward the rear side edge. It is to be noted that image density D shown by line L4 is lower than optimum density D0 at the front side edge and higher than optimum density D0 at the rear side edge.

In the case of line L1, image density D is uniform and proper in the main scanning direction and there is no possibility of causing fog on the copy paper. In this case, it is not necessary at all to adjust image density D and, therefore, tilt angle adjustment of the charge wire 192 is not carried out. In the case of line L2, since image density D becomes increasingly higher than optimum density D0 toward point A at the front side edge, fog is likely to occur in the frontal side part of the copy paper. In the case of line L3, since image density D becomes increasingly higher than optimum density D0 toward point B at the rear side edge, fog is likely to occur in the rear side part of the copy paper. As regards line L4, fog is likely to occur in the rear side part of the copy paper as in the case of L3 while the copied image becomes hardly recognizable near point A at the front side edge where image density D is lower than optimum density D0.

The more the distance between the surface of the photosensitive drum 18 and the charge wire 192, the lower the charge potential on the photosensitive drum 18. In the case of line L2, the charge wire 192 is inclined in such a manner that it becomes more separated from the photosensitive drum 18 at point A at the front side edge. As a result of this adjustment, the charge potential distribution in the axial direction of the photosensitive drum 18 declines toward its front end. By properly adjusting tilt angle of the charge wire 192, it is possible to level off image density D on the copy paper.

If the initial image density distribution is as shown by line L3 or L4, the front end of the charge wire 192 is moved closer to the photosensitive drum 18 so that the charge potential distribution in the axial direction of the photosensitive drum 18 increases toward point A at the front side edge. Further, the voltage applied to the charge wire 192 is reduced to lower the overall charge potential on the photosensitive drum 18 in order to obtain appropriate image density D on the copy paper.

Figure 7A:
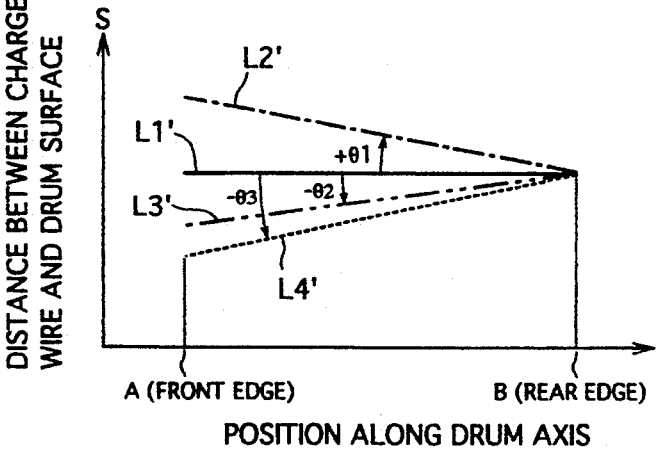
FIGS. 7A and 7B are a graph and a representation of a charge wire and photosensitive drum, respectively, showing tilt angles of a charge wire adjusted in several ways for correcting image density distributions.
Figure 7B:
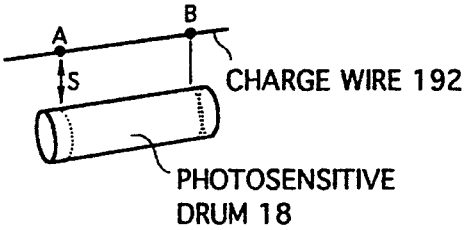

FIG. 7A is a graph showing tilt angles of the charge wire 192 adjusted in several ways for correcting image density D. The vertical axis represents distance S between the charge wire 192 and the surface of the photosensitive drum 18 while the horizontal axis represents position in the axial direction of the photosensitive drum 18. Further, point A on the horizontal axis corresponds to a point on the front side edge of the copy paper while point B corresponds to a point on the rear side edge of the copy paper. An angle formed by the axis of the photosensitive drum 18 and the charge wire 192 is referred to as tilt angle $\theta$.

Figure 6B:
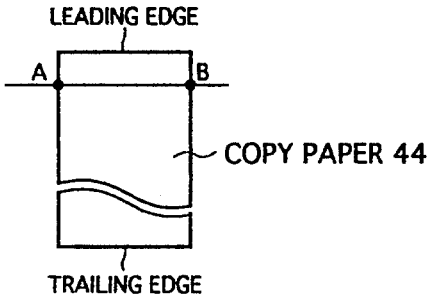

Lines L1' to L4' of FIG. 7A indicate how tilt angle $\theta$ of the charge wire 192 should be adjusted to correct the image density distributions shown by lines L1 to L4 of FIG. 6, respectively.

In case the image density distribution is as shown by line L1 in FIG. 6A, image density D is uniform and proper in the main scanning direction of the copy paper from the beginning. In this situation, tilt angle $\theta$ of the charge wire 192 need not be adjusted and, therefore, it remains at 0 degree as shown by line L1' in FIG. 6A.

If the image density distribution is as shown by line L2 in FIG. 6A, image density D becomes increasingly higher than optimum density D0 toward the front side edge of the copy paper. In this case, point A at the front of the charge wire 192 is moved away from the photosensitive drum 18 to give an appropriate tilt angle of $+\theta 1$ as shown by line L2' in FIG. 7A.

Next, referring to the image density distribution shown by line L3 in FIG. 6A, image density D equals to optimum density D0 at the front side edge point A and progressively increases toward the rear side edge of the copy paper. In this situation, the rear side edge point B of the charge wire 192 may be moved away from the photosensitive drum 18 to give an appropriate tilt angle $-\theta 2$ in order to adjust the image density.

In the embodiment described above, however, the rear end of the charge wire 192 is fixed and only the front end is made movable. Thus, the front end of the charge wire 192 is moved toward the photosensitive drum 18 to form a tilt angle $-\theta 2$ as shown by line L3'. An inconvenience that arises in this case is that the image density distribution evens out at density level D1 of the rear side edge point B as shown by line L5 in FIG. 6A, resulting in an entirely high image density. To cope with this problem, the adjustment of image density distribution shown by line L3 takes a two-step procedure: tilt angle $\theta$ of the charge wire 192 is properly adjusted and then the voltage applied to the charge wire 192 is reduced to bring down the overall density level from D1 to D0.

Figure 8:
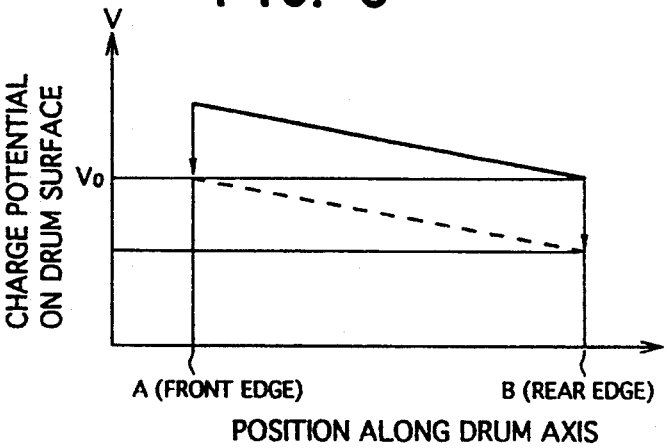
FIG. 8 is a graph showing charge potential distribution on a photosensitive drum after adjusting the tilt angle and applied voltage of the charge wire.

The adjustment for line L3 will be described more precisely with particular reference to FIG. 8. First, the charge wire 192 is adjusted to a predefined tilt angle $-\theta 2$ so that the charge potential distribution in the axial direction of the photosensitive drum 18 is inclined, with the highest potential appearing at the front side of the photosensitive drum 18, as shown by a solid line in FIG. 8. Next, the voltage applied to the charge wire 192 is reduced to lower the overall charge potential as shown by a dashed line in FIG. 8, thereby optimizing image density D on the copy paper.

In a modified form, the image density distribution shown by line L3 may be adjusted by first reducing the voltage applied to the charge wire 192 and then moving point A at the front end of the charge wire 192 closer to the photosensitive drum 18.

In case the distribution of image density D is as shown by line L4 in FIG. 6A, tilt angle $\theta$ of the charge wire 192 and the applied voltage are adjusted in basically the same manner as adopted for line L3. This is because both L3 and L4 rise in the same left to right direction, showing the same tendency in image density distribution although they are positioned differently with respect to optimum density D0. More specifically, tilt angle $\theta$ of the charge wire 192 is first adjusted to $-\theta$ 3 by moving the front side edge point A of the charge wire 192 closer to the photosensitive drum 18 as shown by L4' in FIG. 8 and then the voltage applied to the charge wire 192 is properly reduced. As an alternative, the voltage applied to the charge wire 192 is properly reduced at first and then tilt angle $\theta$ of the charge wire 192 is adjusted to $-\theta$ 3.

As seen above, in image density adjustment mode, unevenness in the distribution of image density D in the main scanning direction is evaluated using copy paper carrying a copied image of the reference original member 17. Then, depending on the result of evaluation, the distribution of image density D in the main scanning direction of the copy paper is evened out by adjusting tilt angle $\theta$ of the wire 192 and the voltage applied to the charge wire 192. In the above embodiments described, tilt angle $\theta$ of the charge wire 192 is varied in a positive or negative direction by moving the front end of the charge wire 192 up and down. In a modified form, both ends of the charge wire 192 may be made movable so that the whole of the charge wire 192 can be moved up and down, yet allowing its tilt angle $\theta$ to be adjusted in either direction. With this arrangement, charge potential on the photosensitive drum 18 can be adjusted to desired image density D only by mechanical adjustment of the charge wire 192.

Figure 9:
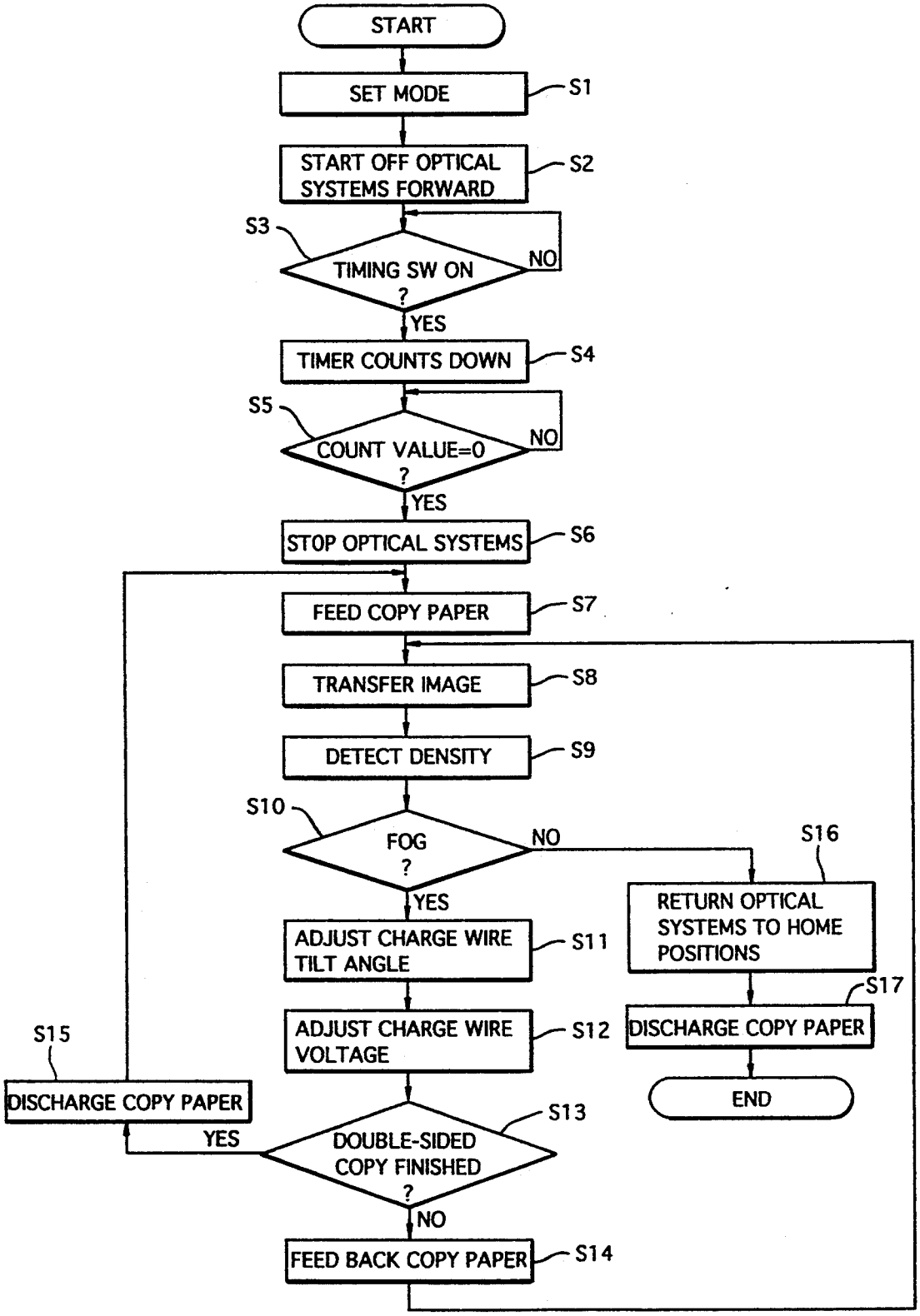
FIG. 9 is a flowchart showing an image density adjustment procedure in image density adjustment mode.

Referring now to a flowchart of FIG. 9, an operational sequence of density adjustment in image density adjustment mode will be described. When image density adjustment mode is selected by the mode select switch 54 (Step S1), the luminous intensity controller 59 causes the tungsten halogen lamp 4 to light at a specified luminous intensity while the optical system drive controller 58 sets the first and second optical systems 11–12 to make a forward movement (Step S2). Subsequently, when the first optical system 11 is detected by the timing switch 15 in its returning stroke (Step S3), the timer 55 starts counting down a preset period of time (Step 54). When the time count has reached 0 (YES in Step S5), the returning stroke of both the first and second optical systems 11–12 is put to an end (Step S6). At this point, the first optical system 11 is set just under the reference original member 17.

Next, a sheet of copy paper is fed from the paper cassette 24 (Step S7) and an image of the reference original member 17 is formed and transferred onto the sheet. In this process of image forming, the tungsten halogen lamp 4 is controlled to light at a preset luminous intensity while the charge wire 192 and a developing roller are charged by applying a predetermined charge voltage and a bias voltage, respectively. Further, the image of the reference original member 17 exposes the photosensitive drum 18 at specified timing in synchronism with the feeding of the copy paper. In this process, the image of the reference original member 17 is formed within a limited area near the leading side edge of the copy paper, from which area the density detecting unit G can detect the image density (Step S8).

The copy paper carrying the image of the reference original member 17 is led into the paper inverting mechanism K to reverse its feed direction and guided to the intermediate tray 35 through the interconnecting path 36. When the copy paper has been placed on the intermediate tray 35, the density detecting unit G begins to detect image density D across the copy paper in the main scanning direction and the resultant image density data is stored in the internal memory 531 of the CPU 53 (Step S9).

The measured density data is compared with the optimum density data stored in the memory 56 to check if the former falls within predefined limits (Step S10). If the measured density data is within the limits (NO in Step S10), it is judged that there is no fog on the copy paper. In this case, the operation flow proceeds to Step S16 without adjusting tilt angle $\theta$ of the charge wire 192. Then, the first and second optical systems 11–12 are returned to their home positions (Step S16) and the copy paper on the intermediate tray 35 is discharged onto the copy output tray 30 (Step S17), where the sequence of image density adjustment is completed.

On the other hand, if the measured density data goes beyond the limits in Step S10, it is judged that there is fog on the copy paper (YES in Step S10). In this case, desired tilt angle $\theta$ and charge voltage of the charge wire 192 are calculated based on the measured density data and then the tilt angle and charge voltage of the charge wire 192 are adjusted accordingly (Steps S11 and S12). Target values for tilt angle $\theta$ and charge voltage of the charge wire 192 may be obtained from reference data previously stored in the internal memory 531 of the CPU 53 in the form of conversion tables, or calculated from the difference between the measured density data and optimum density data. Then, based on the target values derived from reference data or calculation, the motor 196 and charge voltage adjuster 57 are driven to properly adjust the tilt angle $\theta$ and charge voltage of the charge wire 192.

Subsequently, the double-sided copy detector 61 checks if copying on both sides of the copy paper has been completed (Step S13). If double-sided copying has not been finished yet (NO in Step S13), the copy paper is fed again up to the photosensitive drum 18 (Step S14). In this case, the operation flow returns to Step S8 and an image of the reference original member 17 is copied on the reverse side of the copy paper. Then, by detecting the image density distribution on the reverse side of the copy paper, image density D after adjustment is verified (Steps S9 and S10). If it is ascertained that image density D after adjustment is appropriate (NO in Step S10), the operation flow proceeds to Step S16 where the sequence of image density adjustment is completed.

On the other hand, if image density D after adjustment is inappropriate (YES in Step S10), tilt angle $\theta$ and charge voltage of the charge wire 192 are readjusted (Steps S11 and S12).

If double-sided copying is already complete in Step S13, the copy paper on the intermediate tray 35 is discharged onto the copy output tray 30 (Step S15) and, returning to Step S7, another sheet of copy paper is fed from the paper cassette 24 to repeat the above adjustment procedure.

In the above embodiments, the copying machine 1 is provided with a built-in reference original member 17. If this is not the case, a reference original member may be placed on the original glass plate 2 and by reading an image of the reference original member, the copying machine 1 can perform adjustment of image density D in a similar way.

In the above embodiments, the density detecting unit G including a combination of the light emitting device 491 and photosensitive device 492 is moved in the main scanning direction of the copy paper to detect image density D. As an alternative, a line sensor, or a linear array of light-sensitive devices, may be provided on the downstream side of the separator 22 in order to read a transferred image in the main scanning direction of the copy paper for detecting image density D. With this alternative arrangement, image density D can be detected while the copy paper is being sent forward, making it possible to quicken the process of image density adjustment. Furthermore, it would be possible to adjust image density D even when the copying machine is not provided with the double-sided copying function.

Also in the above embodiments, image density adjustment mode is selected by mean of the mode select switch 54. In a varied form, the copying machine 1 may be automatically set to image density adjustment mode each time the power is turned on or a specified number of copies have been produced.

In the above embodiments, the image density distribution in the main scanning direction of the copy paper is evened out by adjusting the tilt angle and charge voltage of the charge wire 192 based on the density data detected by the density detecting unit G. In another variation, the luminous intensity of the tungsten halogen lamp 4 or the developing bias is adjusted based on the same density data, and in this manner average image density D over the whole area of the copy paper can be controlled with a pretty high accuracy. The density detecting unit G provides accurate and stable data on image density distribution because it detects image density D in the main scanning direction while the copy paper is placed still on the intermediate tray 35 after the image transfer process. It would be understood, therefore, that the luminous intensity of the tungsten halogen lamp 4 or the developing bias can be precisely and finely controlled by the use of the image density distribution data.

In the variations of involving the adjustment of luminous intensity of the tungsten halogen lamp 4 in image density adjustment mode. Steps S11 and S12 of the flowchart of FIG. 9 are changed so as to execute operations of "calculation of a luminous intensity adjustment value for the tungsten halogen lamp 4 and registration of the calculation result in the memory 531." With this modification, basically the same operation flow can be used to control the process of image density adjustment.

In case the operating procedure has been modified as described above, the luminous intensity adjustment value for the tungsten halogen lamp 4 is calculated in Step S11 using the image density data detected by the density detecting unit G and the preset optimum density data. Then, in Step S12, the calculation result is registered in the memory 531. From Step S13, the sequence will return to Step S7 via Step S15 or to Step S8 via Step S14. In either case, when an image of the reference original member 17 is formed again, the luminous intensity controller 59 reads the luminous intensity adjustment value from the memory 531 and causes the tungsten halogen lamp 4 to light at an adjusted luminous intensity.

In the variation that involves adjustment of the developing bias, the operation flow is changed partially modified in a similar to manner to the case of adjusting the luminous intensity of the tungsten halogen lamp 4. After modification, it will become possible to control the average image density D over the whole area of the copy paper using the flowchart of FIG. 9.

In the above variation that involves adjustment of the luminous intensity of the tungsten halogen lamp 4 or the developing bias, what is used as the density data for calculating adjustment values is the image density distribution in the main scanning direction of the copy paper. In yet another variation, an integral value or a peak value of image density D detected by the density sensor 49 may be used as the density data.

In the preferred embodiments described above, image density D is detected only in the main scanning direction of the copy paper. Alternatively, image density D may be detected also in the secondary scanning direction when the copy paper is being sent out from the intermediate tray 35. This arrangement will make it possible to evaluate the fog status in the secondary scanning direction of the copy paper as well.

Furthermore, in the preferred embodiments, image density D is detected in the main scanning direction of the copy paper while moving the single-element density sensor 49 in that direction. Alternatively, a linear image sensor array such as a charge-coupled device (CCD) aligned in the main scanning direction of the copy paper may be used to detect image density D. This alternative arrangement will not only simplify the construction of the density detecting unit G by eliminating the need for the density sensor drive assembly but quicken the process of image density detection.

Also in the above embodiments, image density adjustment mode is selected by operating the mode select switch 54 in order to adjust the image density. In a varied form, the operation of image density adjustment mode may be automatically executed each time the power is turned on or a specified number of copies have been produced or at regular intervals of elapsed time.

The copying machine 1 of the present invention may additionally be provided with indicator means on a control panel (not illustrated), for example. It may happen at worst that a target value for tilt angle $\theta$ of the charge wire 192 cannot be determined if fog persists even after executing image density adjustment several times according to the flowchart of FIG. 9 as previously described with reference to the preferred embodiment. In such a case, the indicator means should annunciate improper image density or the need of servicing.

While the invention has been described as being embodied in a copying machine, it is to be understood that application of the invention is not limited thereto but may be embodied in various types of image forming apparatuses including a facsimile machine within the scope of the following claims.

What is claimed is:

1. An image forming apparatus comprising:

a photosensitive body;

a charge wire disposed along the photosensitive body at a specified spacing from the photosensitive body and adapted for charging the photosensitive body, the charge wire being tiltable in a plane passing through the axis of the photosensitive body wire and perpendicularly intersecting a surface of said photosensitive body;

detecting means for detecting an image density distribution in a main scanning direction of copy paper carrying a copied image of an original document;

tilt angle calculating means for calculating, based on a detected image density distribution, a correcting tilt angle of the charge wire to obtain a desired image density distribution in the main scanning direction; and tilt angle control means for controlling the tilt angle of the charge wire in accordance with a calculated correcting tilt angle.

2. An image forming apparatus according to claim 1 further comprising:

voltage calculating means for calculating, based on a detected image density distribution, a correcting application voltage for the charge wire to obtain a specified image density; and voltage control means for controlling the application voltage for the charge wire in accordance with a calculated correcting application voltage.

3. An image forming apparatus according to claim 1 further comprising memory means for storing information about optimum image density distribution for a reference original member, wherein the tilt angle calculating means calculates a correcting tilt angle of the charge wire comparing a detected image density distribution with the optimum image density distribution.

4. An image forming apparatus according to claim 1 further comprising:

document holder means having a document holding portion for holding an original document and a reference original member outside the document holding portion; and scanning means for scanning the original document and reference original member, the scanning means being capable of selectively scanning either of the reference original member and the original document.

5. An image forming apparatus according to claim 1 wherein the detecting means includes a sensor having a plurality of photoelectric devices arranged in a main scanning direction of copy paper.

6. An image forming apparatus according to claim 1 wherein the detecting means includes:

a reflection type sensor capable of detecting an image density based on an amount of reflected light from copy paper; and a driving portion for moving the reflection type sensor in a main scanning direction of copy paper; and a controlling portion for controlling the driving portion.

7. An image forming apparatus according to claim 1 further comprising a shield case having an opening facing an surface of the photosensitive body, and opposite end portions between which the charge wire is tightened, one of the opposite end portions being movable so as to change the tilt angle of the charge wire.

8. An image forming apparatus according to claim 1 further comprising paper refeeding means for refeeding copy paper having a copied image on one side thereof to the photosensitive body to form another image on the other side of the copy paper, the paper refeeding means having intermediate paper storage means for temporarily storing the copy paper having a copied image on one side thereof, wherein the detecting means is provided above the intermediate paper storage means to detect an image density of a copied image on the one side of the copy paper stored on the intermediate paper storage means.

9. An image forming apparatus according to claim 8 further comprising:

judgement means for judging whether the tilt angle of the charge wire is adjusted;

refeeding controlling means responsive to the judgment means for controlling the refeeding means to refeed the copy paper carrying a copied image on one side thereof to the photosensitive body to form the image of the reference original member on the other side of the copy paper if the tilt angle of the charge wire is adjusted, and controlling the refeeding means to convey the copy paper carrying a copied image of the reference original member on the other side to the intermediate paper storage means to detect an image density distribution of the copied reference original image.

* * * * *